US009269521B2

(12) United States Patent
Tabib-Azar

(10) Patent No.: US 9,269,521 B2
(45) **Date of Patent: *Feb. 23, 2016**

(54) MICRO-PLASMA FIELD EFFECT TRANSISTORS

(71) Applicant: UNIVERSITY OF UTAH RESEARCH FOUNDATION, Salt Lake City, UT (US)

(72) Inventor: Massood Tabib-Azar, Salt Lake City, UT (US)

(73) Assignee: UNIVERSITY OF UTAH RESEARCH FOUNDATION, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/608,298

(22) Filed: Jan. 29, 2015

(65) Prior Publication Data

US 2015/0162158 A1 Jun. 11, 2015

Related U.S. Application Data

(63) Continuation-in-part of application No. 14/167,458, filed on Jan. 29, 2014, now abandoned, which is a continuation of application No. 13/586,717, filed on Aug. 15, 2012, now Pat. No. 8,643,275.

(60) Provisional application No. 61/628,876, filed on Nov. 8, 2011, provisional application No. 61/933,050, filed on Jan. 29, 2014.

(51) Int. Cl.
*H01J 17/46* (2006.01)
*H01J 17/06* (2006.01)

(Continued)

(52) U.S. Cl.
CPC ..... *H01J 17/066* (2013.01); *H01J 17/04* (2013.01); *H01J 17/16* (2013.01); *H01J 17/49* (2013.01)

(58) Field of Classification Search
CPC ..... H01J 17/04; H01J 17/066; H01J 17/16; H01J 17/49
USPC ..... 313/153–162, 581–587
See application file for complete search history.

(56) References Cited

U.S. PATENT DOCUMENTS 5,387,777 A 2/1995 Bennett et al.
8,643,275 B2 2/2014 Tabib-Azar (Continued)

OTHER PUBLICATIONS

United States Patent Office Action for U.S. Appl. No. 14/167,458 dated Dec. 4, 2014 (7 pages).

(Continued)

*Primary Examiner* — Tracie Y Green
(74) *Attorney, Agent, or Firm* — Michael Best & Friedrich LLP

(57) ABSTRACT

In some aspects, a micro-plasma device comprises a plasma gas enclosure containing at least one plasma gas, and a plurality of electrodes interfaced with the plasma gas enclosure. In other aspects, a micro-plasma circuitry apparatus comprises a first layer having a cavity formed therein and a second layer having a circuit formed therein. The circuit includes a micro-plasma circuit ("MPC") that includes one or more micro-plasma devices ("MPDs"). The first layer of the circuit is bonded to the second layer of the circuit thereby forming an enclosure that contains at least one plasma gas. An excitation voltage is applied to a drain electrode of the MPDs to generate a conductive plasma path between the drain electrode and a source electrode.

34 Claims, 21 Drawing Sheets

(51) Int. Cl.

| | |
|---|---|
| ***H01J 17/49*** | (2012.01) |
| ***H01J 17/04*** | (2012.01) |
| ***H01J 17/16*** | (2012.01) |

(56) References Cited

U.S. PATENT DOCUMENTS

| | | | | |
|---|---|---|---|---|
| 2010/0236917 | A1 | 9/2010 | Mori | |
| 2011/0024048 | A1 | 2/2011 | Nakamura et al. | |
| 2012/0115314 | A1 | 5/2012 | Sakamoto et al. | |
| 2014/0159571 | A1 * | 6/2014 | Hopwood et al. | 315/39 |

OTHER PUBLICATIONS

United States Patent Office Action for U.S. Appl. No. 13/586,717 dated Jun. 7, 2013 (7 pages).

* cited by examiner 1505
1500

1510
1515
1520

1525

1560

MICRO-PLASMA FIELD EFFECT TRANSISTORS

RELATED APPLICATIONS

This application is a continuation-in-part of U.S. patent application Ser. No. 14/167,458, filed Jan. 29, 2014, which is a continuation of U.S. patent application Ser. No. 13/586,717, filed Aug. 15, 2012, now U.S. Pat. No. 8,643,275, which claims the benefit of U.S. Provisional Patent Application No. 61/628,876, filed Nov. 8, 2011, the entire contents of which are hereby incorporated by reference. This application also claims the benefit of U.S. Patent Application No. 61/933,050, filed Jan. 29, 2014, the entire content of which is also hereby incorporated by reference.

STATEMENT REGARDING FEDERALLY SPONSORED RESEARCH OR DEVELOPMENT

This invention was made with government support under N00014-11-1-0932 awarded by the Office of Naval Research. The government has certain rights in the invention.

TECHNICAL FIELD

The present description relates generally to field effect transistors, and relates in particular to micro-plasma field effect transistors.

BACKGROUND

Complementary metal-oxide-semiconductor ("CMOS") devices, metal-oxide-semiconductor field-effect transistor ("MOSFET") devices, and other semiconductor switching devices generally do not tolerate harsh environments, such as heat and radiation. For example, a typical CMOS or MOSFET will usually fail at temperatures exceeding 200° C. As a result, computers or processors may fail in an emergency fire condition, and cannot be placed inside high-temperature devices such as internal combustion engines. Additionally, CMOS or MOSFET devices will fail in high radiation environments. As a result, computers or processors can become disabled in the presence of ionizing radiation produced by reactors during, for example, an emergency requiring intervention using robots or other computerized devices.

The vulnerability of semiconductor switching devices to extreme heat and radiation stems from the nature of semiconductor materials. Semiconductor materials are responsive to stimulation in order to become more conductive, and electrical signals are used to selectively stimulate the materials in order to cause conduction. However, heat and ionizing radiation can also stimulate semiconductor materials. As a result, the semiconductor materials simply short out when excited by heat or ionizing radiation. Accordingly, there is a need for switching devices that can tolerate such harsh environments.

SUMMARY

The present application provides for systems devices and methods which provide for micro plasma field effect transistors. Further, embodiments may provide for such transistors that have a capability to withstand high-temperature or radioactive environments.

In some aspects, a micro-plasma device comprises a plasma gas enclosure containing at least one plasma gas, a plasma generation circuit interfaced with the plasma gas enclosure, and a plurality of electrodes interfaced with the plasma gas enclosure. In other aspects, a micro-plasma circuitry apparatus comprises a first layer having plasma generating electrodes, a second layer having a cavity formed therein, and a third layer having a circuit formed therein. The circuit includes a micro-plasma circuit ("MPC") that includes one or more micro-plasma devices ("MPDs"). A metallic layer covers the MPC except at locations of the MPDs. The first layer is bonded to the second layer and the second layer is bonded to the third layer, thereby forming an enclosure that contains at least one plasma gas.

In one embodiment, the invention provides a micro-plasma device that includes a plasma gas enclosure, a drain electrode, and a source electrode. The plasma gas enclosure contains at least one plasma gas. The drain electrode is interfaced with the plasma gas enclosure, and the source electrode is interfaced with the plasma gas enclosure. The drain electrode and the source electrode are separated from each other by a distance. The micro-plasma device is configured, when a voltage signal having a value greater than a breakdown voltage of the plasma gas between the drain electrode and the source electrode is applied to the drain electrode, to generate a conductive plasma path through the at least one plasma gas between the drain electrode and the source electrode.

In another embodiment, the invention provides a micro-plasma circuitry apparatus that includes a first layer and a second layer. The first layer has a cavity formed therein, and the second layer has a circuit formed therein including an MPC that includes one or more MPDs. The first layer is bonded to the second layer to form an enclosure that contains a plasma gas.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention. Unless indicated to the contrary, uses of the word "approximately" or "about" to modify a value includes an implied range of potential values of between +/−5% or +/−10%.

BRIEF DESCRIPTION OF THE DRAWINGS

For a more complete understanding of the present invention, reference is now made to the following descriptions taken in conjunction with the accompanying drawings, in which:

FIG. 2(*b*) depicts an isometric view of a MOPFET in accordance with the present disclosure;

FIG. 3(*b*) depicts another graphical representation of MOPFET Ids–Vds characteristics in accordance with the present disclosure;

FIG. 4(*b*) a sectional view of the IDT fields in accordance with the present disclosure;

FIG. 4(*c*) and a graphical representation of the position dependence of plasma conductance in accordance with the present disclosure;

FIG. 5(*b*) depicts a graphical representation of plasma conductance as a function of excitation frequency in accordance with the present disclosure;

FIG. 5(*c*) depicts a graphical representation of plasma conductance as a function of excitation amplitude in accordance with the present disclosure;

FIG. 6(*b*) depicts a diagrammatic view of a NOR gate in accordance with the present disclosure;

FIG. 6(*c*) depicts a diagrammatic view of a NAND gate in accordance with the present disclosure;

FIG. 7(*b*) depicts a sectional view of an anodic bonding arrangement in accordance with the present disclosure.

DETAILED DESCRIPTION

The present disclosure is directed to microplasma devices ("MPD") capable of operating in ionizing radiations and at high temperatures (e.g. temperatures ranging between 200-600° C.). In some embodiments, an external radio frequency ("RF") plasma source provides plasma to the MPD to eliminate the uncertainty associated with ignition. In other embodiments, the MPD generates its own plasma without an external plasma source. In some embodiments, Micro-plasma circuits ("MPC") capable of performing simple logical functions such as NOT, NOR and NAND may be provided. Plasma devices for amplification and mixing may also be provided. Metal and ceramic resistors and capacitors may be used along with metallic inductors in the MPCs. Quartz resonators, tested to operate in radiation environment without deterioration, may be used for clocks. MPC devices may be connected using shielded metal lines to prevent distributed parasitic interactions with the plasma.

Figure 1:
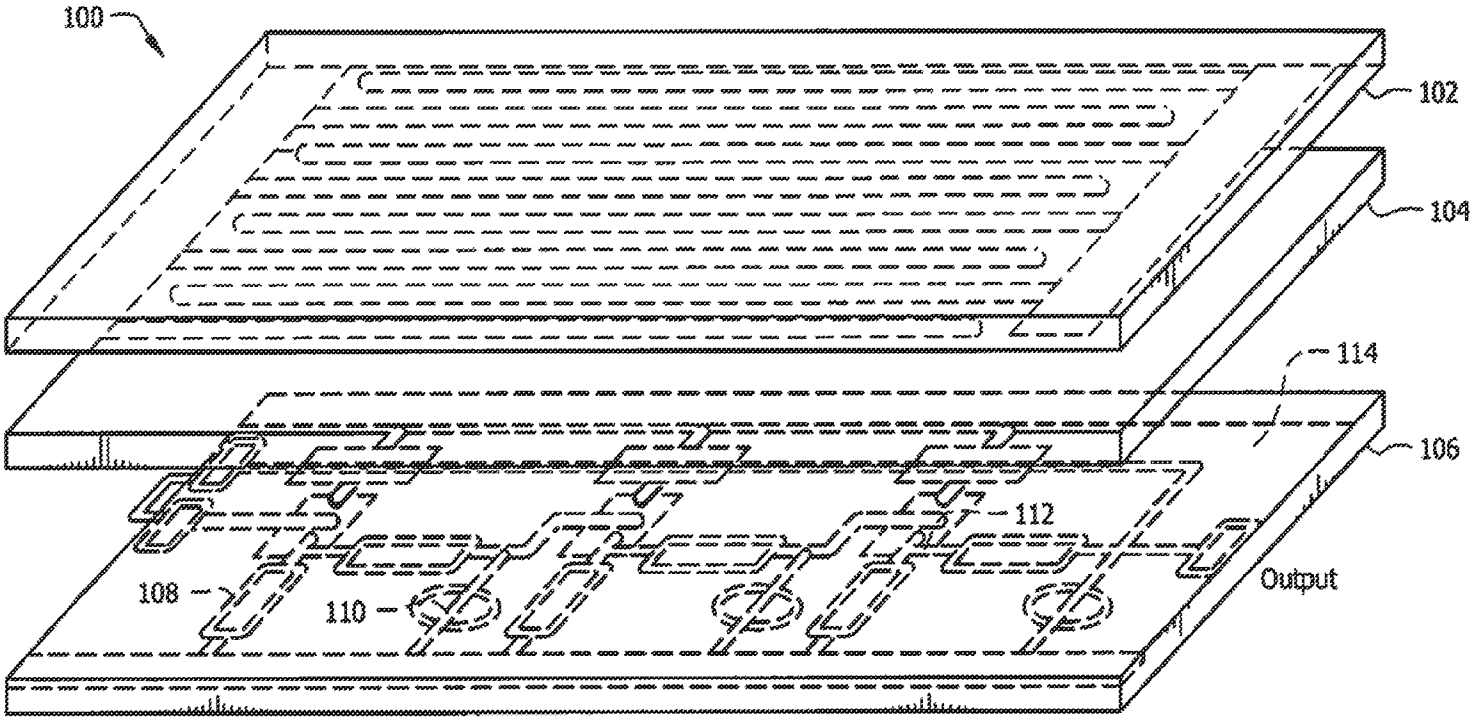
FIG. 1 depicts a schematic of a micro-plasma circuit chip in accordance with the present disclosure.

Referring to FIG. 1, a micro-plasma circuit, according to one embodiment, may be comprised of fused silica or similar materials, which do not deteriorate in ionizing radiation. The micro-plasma circuit chip 100 may be composed of three main fused silica sections. A top fused silica plate 102 may contain RF plasma generation electrodes forming an RF plasma generation circuit, and it may be bonded to a middle fused silica section 104 that encloses the plasma gases and the plasma. Example plasma gases can be noble gases, such as Helium ("He"), Xenon ("Xe"), Neon ("Ne"), Argon ("Ar") and the like. A bottom fused silica plate 106 may contain the circuit, such as a ring oscillator. The circuit may include standard elements, such as resistors 108 and capacitors 110. However, the circuit also includes the MPD 112 and MPCs. The MPC may be shielded from the plasma with a metallic layer 114 that covers the MPC everywhere except in the MPD regions.

Figure 2A:
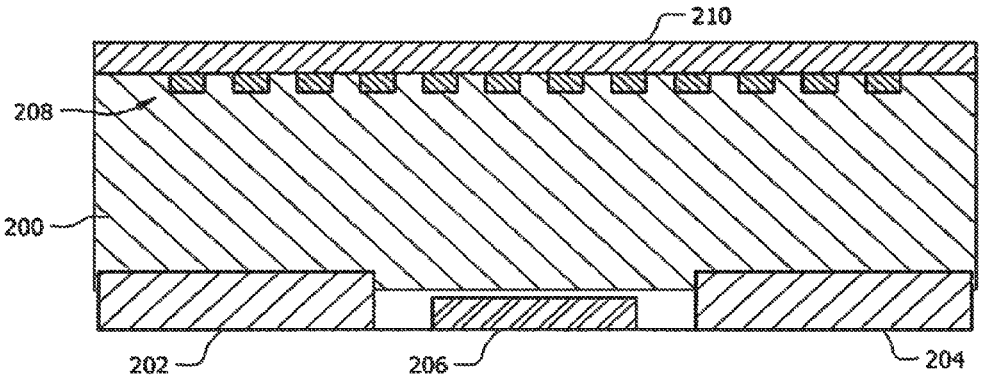
FIG. 2(*a*) depicts a sectional view of a metal-oxide-plasma field-effect transistor (MOPFET) device in accordance with the present disclosure.
Figure 2B:
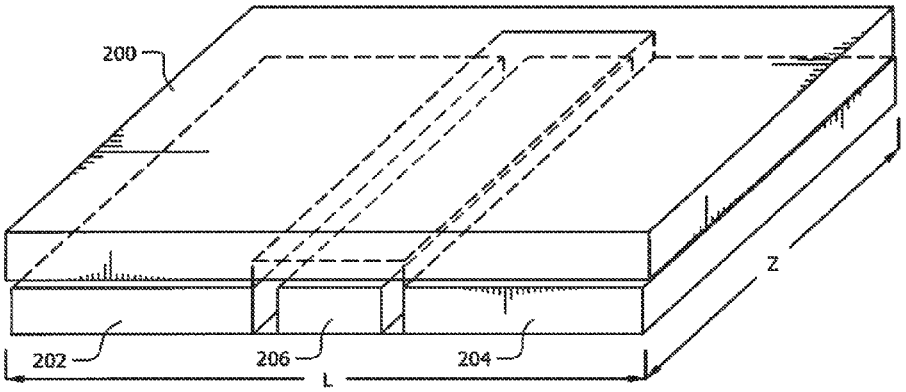

According to some embodiments, the MPDs may comprise metal-oxide-plasma field-effect transistors ("MOPFET")

that may serve as switching and amplifying devices for the MPCs. Compared to field-emission and micro-vacuum devices, separate generation of plasma enables MOPFETs to operate at lower voltage levels and higher currents, and with much higher reproducibility and reliability. FIG. 2 provides a schematic of such a MOPFET.

Referring generally to FIG. 2, a MOPFET may have a plasma region 200 in contact with two exposed metallic electrodes, including a drain electrode 202 and a source electrode 204, separated by an insulated gate 206. Depending on the density of the plasma and the nature of the boundary layer, the MOPFET may be designed to operate as an enhancement-mode ("E-MOPFET") device, or as a depletion-mode ("D-MOPFET") device. Although it is possible to have negative carriers, positive ions are presently preferred because they prove to be more stable in the plasma. Referring particularly to FIG. 2(*a*), the plasma ions that are generated using the RF plasma electrodes 208 of the top plate 210 remain ionized and can be detected for relatively long distances up to a few millimeters. The positive ion mobilities (μ) are around 1-0.01 $cm^2/V_{DS}$ in 1 atmosphere pressure at room temperature. Referring to FIG. 2(*b*), for gate length L, in the constant ion mobility regime, the MOPFET switching speed can be estimated as $\tau_s \sim L^2/(\mu V_{DS})$. For $\tau_s$=100 ps, the gate length L of 5 μm requires $V_{DS}$ of 25V, assuming $\mu \sim 1\ cm^2/V_{DS}$, wherein t may be calculated according to EQN. 1:

$$\mu = 0.4047\left(\frac{\pi}{2}\right)^{1/2}\frac{e\tau_0}{m}\left(1 - 0.1075\frac{v_d^2}{v_s^2}\right) \quad \text{EQN. 1}$$

Figure 3A:
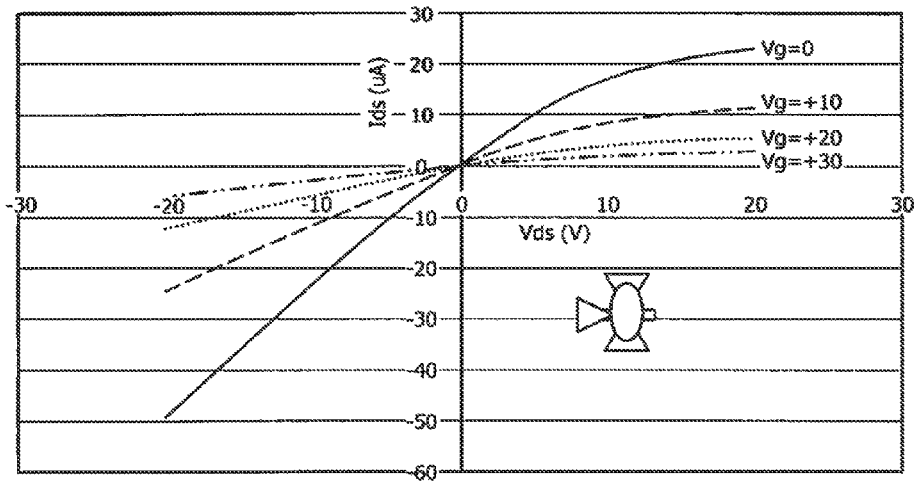
FIG. 3(*a*) depicts a graphical representation of MOPFET Ids–Vds characteristics in accordance with the present disclosure.
Figure 3B:
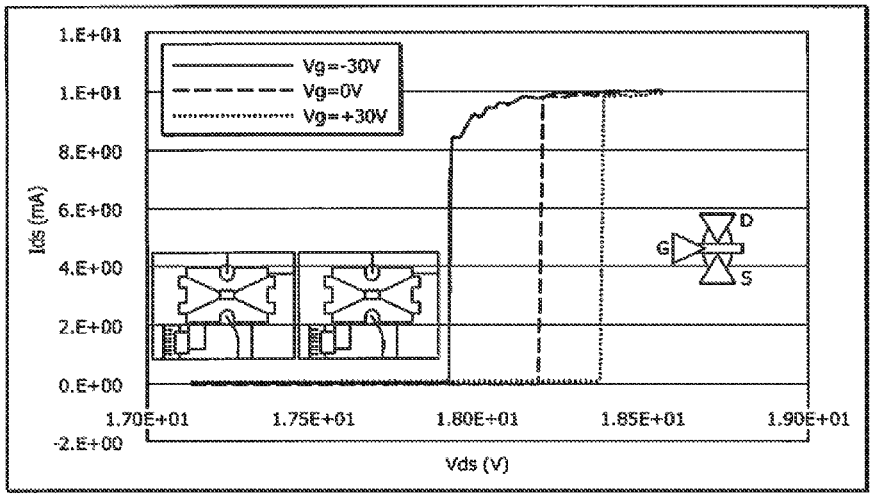

FIG. 3 illustrates Ids–Vds characteristics during two different operation regimes of MOPFETs as experimentally measured utilizing He at 1 atmosphere at room temperature. Referring to FIG. 3(*a*), in which $I_{ds}$ is measured in μA, if the plasma ion density is sufficiently high near the D-S regions, the gate field effect depletes the D-S channel to reduce the channel conductance, and the MOPFET operates as a depletion mode device. The role of the gate electrode, in this case, is to deplete the positive ions in the channel to reduce the $I_{DS}$ at any $V_{DS}$. Referring to FIG. 3(*b*), in which $I_{ds}$ is measured in mA as limited by the Keithley SMU 267 current compliance to 10 mA, the same MOPFET operates as an enhancement mode device. The enhancement mode device operation is achieved when the plasma density is low, but sufficient to enable $V_{DS}$ to ionize near-by gas molecules and increase the D-S channel conductance. The ionization voltage depends on plasma density, gate voltage, gate capacitance, and device geometry. The plasma device intensity reduces when $+V_g$ is applied. Accordingly, when the plasma density is low but sufficient to enable ionization between drain and source at low voltages, the MOPFET characteristics change, allowing the MOPFET to be used as a switch having a turn-on voltage controlled by the gate voltage. The MOPFET characteristics discussed above demonstrate that the MOPFET may be used as a switch very similar to PMOS.

Accordingly, logic gates using MOPFETs may be designed, and device equations may be developed to relate $I_{ds}$–$V_{ds}$ and $V_{gs}$ to device parameters, such as gate oxide, plasma density, pressure, temperature, and geometry.

Figure 4A:
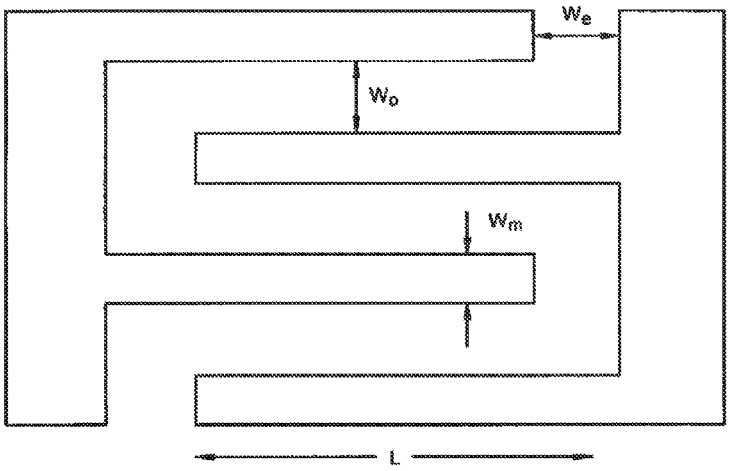
FIG. 4(*a*) depicts a plan view of interdigital transducers ("IDTs") for RF plasma generation in accordance with the present disclosure.
Figure 4B:
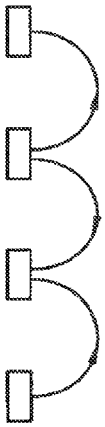
Figure 4C:
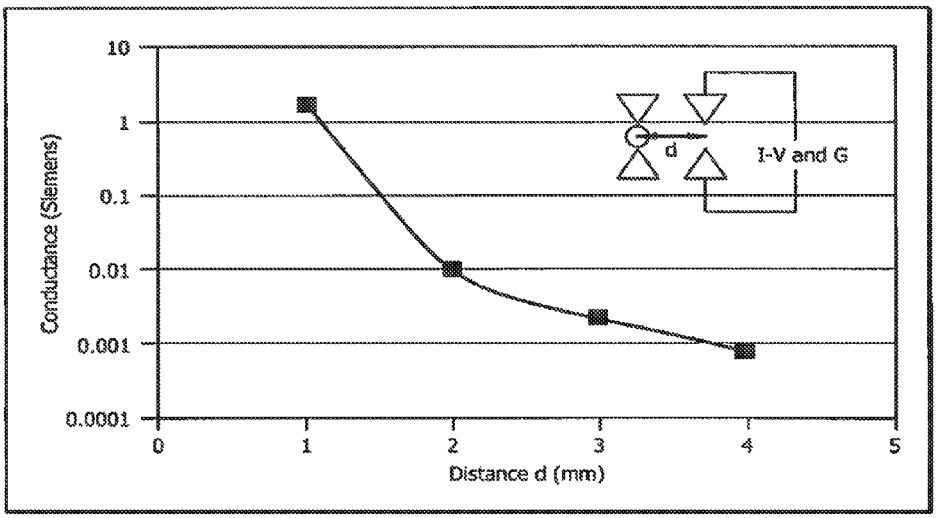

A family of efficient RF plasma sources may provide the necessary ion densities for MPCs. The Interdigital Transducer (IDT) RF electrode geometry shown in FIG. 1 is ideal for generating high density plasmas in pressures ranging from $10^{-3}$ Torr up to atmospheric pressure. This pressure range can be maintained inside the bonded package. Referring to FIG. 4(*a*), the IDTs can be designed to have different overlap ($L-W_e$), distance ($W_o$), electrode areas, and number of pairs. The distance can be graded to produce different field intensities at different locations. Referring to FIG. 4(*b*), an IDT field pattern can be used to adjust the plasma density. Referring to FIG. 4(*c*), plasma intensity is observed to vary as a function of distance. The plasma density has a spatial decay length of around 1 mm for He at 1 atmosphere at 480 MHz with $W_o \sim W_m \sim W_e \sim 1$ mm with one pair of IDT. A magnetic field may be employed to increase collision rate and thereby increase plasma density. Other parameters that can be taken into consideration in the design are RF power, frequency, IDT parameters, surface nano-texturing (hollow cathode effect), and gases. An equation may express the plasma decay length as a function of IDT parameters, pressure, gases (e.g., electronegative gases such as $O_2$ have completely different decay properties than He), frequency, RF power, and temperature.

Figure 5A:
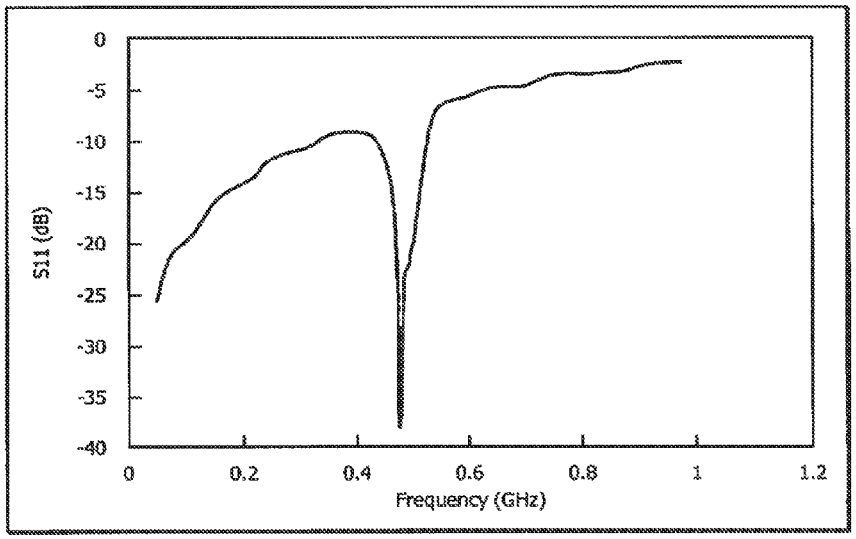
FIG. 5(*a*) depicts a graphical representation of the reflection coefficient of a single pair IDT after impedance matching in accordance with the present disclosure.
Figure 5B:
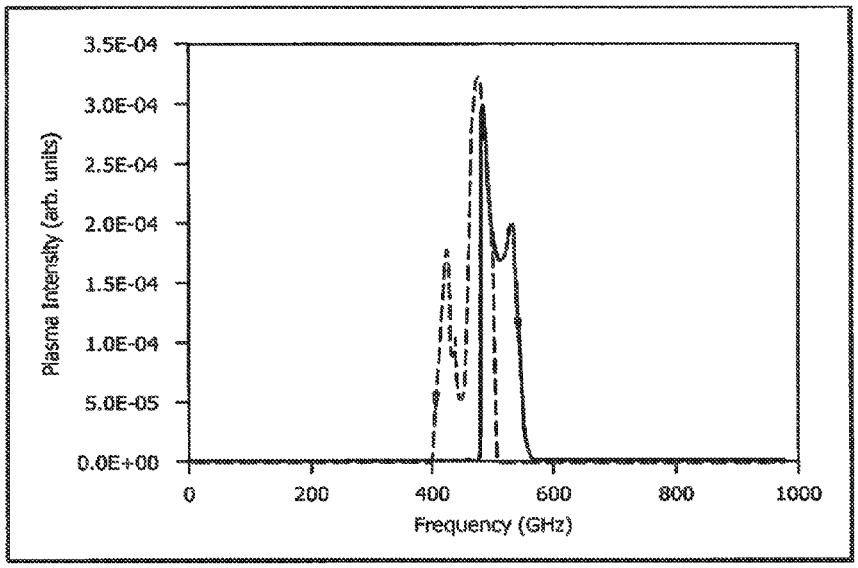
Figure 5C:
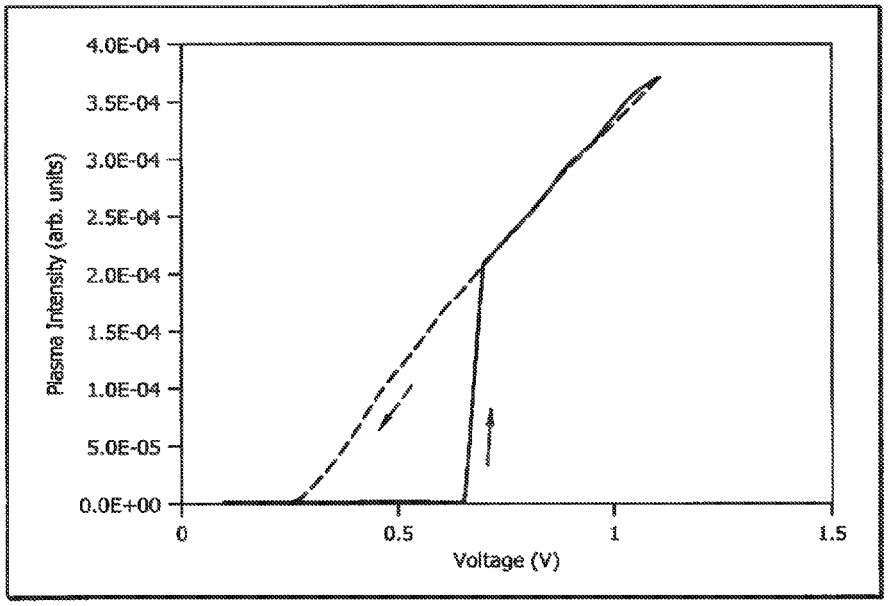

Turning now to FIG. 5(*a*), $S_{11}$ of a single pair IDT is shown after impedance matching. The IDTs are primarily capacitive, and impedance matching requires an inductor. Referring to FIG. 5(*b*), the plasma conductance as a function of excitation frequency at constant amplitude exhibits hysteresis that is usually observed in highly nonlinear processes such as gas ionization. Referring to FIG. 5(*c*), hysteresis is also observed in plasma conductance as a function of excitation amplitude at constant frequency.

Figure 6A:
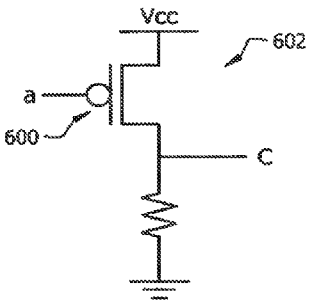
FIG. 6(*a*) depicts a diagrammatic view of an inverter in accordance with the present disclosure.
Figure 6B:
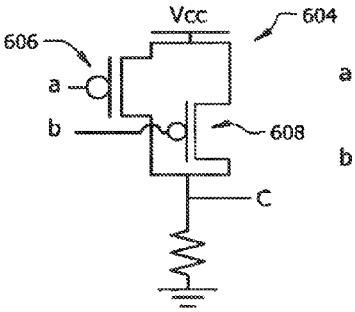
Figure 6C:
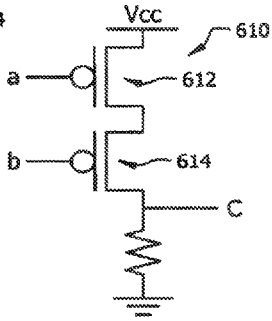

Referring now to FIG. 6, logic gates may be developed using MOPFETs. For example, FIG. 6(*a*) provides an example of an inverter employing a single MOPFET 600 to form a NOT gate 602. Additionally, FIG. 6(*b*) provides an example of a NAND gate 604 employing a first MOPFET 606 and a second MOPFET 608. Also, FIG. 6(*c*) provides an example of a NOR gate 610 employing a first MOPFET 612 and a second MOPFET 614. It will be appreciated that NOR and NAND gates are universal, and any other gates can be constructed using NOR or NAND gates. It is envisioned that D-latches and flop-flops can be constructed as well. In digital logic, the most important MOPFET parameters are speed and transition (on to off) voltages. Accordingly, it is envisioned that Non-Volatile Memory devices may be developed.

Fused silica substrates and refractory metals with low sputtering yields may be utilized as materials to increase the MPCs operation lifetime in radiation and high temperatures. Preliminary studies clearly show that, for high performance MPDs, inorganic high temperature substrates (i.e., fused silica) are superior to other substrates. Different sections of the MP chips may be bonded (anodic and eutectic) to provide sealed cavities for plasma gases.

It is possible to physically grow nano-wires between the drain and source contacts and proper gate biasing and an appropriate gas containing carbon, silicon and any other material that is conducting and can be deposited from a precursor gas. Precursor gases can be located in cavities next to MOPFETs. When the cavities or precursors are activated, the MOPFET can use the gas to form a nano-wire junction between its drain and source using a modified Plasma Enhanced CVD process. The nano-wires can be turned off by applying sufficiently large $V_{ds}$.

Figure 7A:
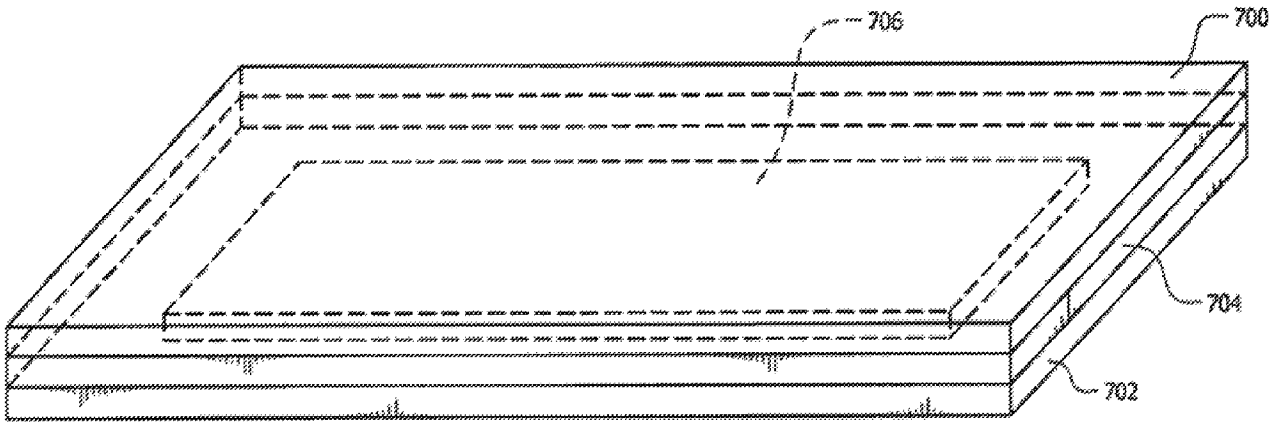
FIG. 7(*a*) depicts an isometric view of an anodic bonding arrangement in accordance with the present disclosure.
Figure 7B:
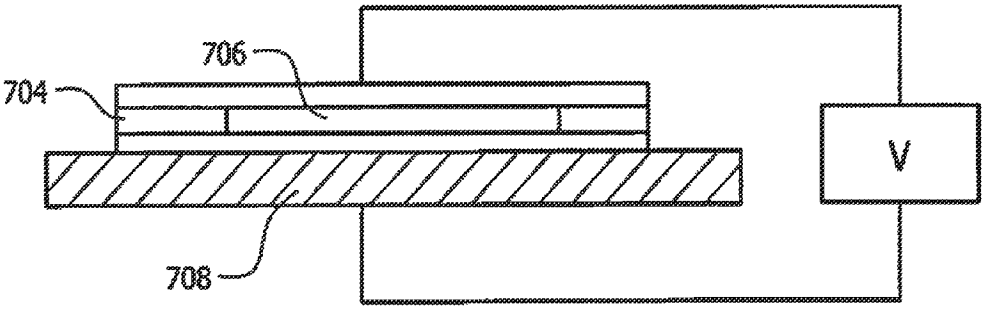

Referring to FIG. 7(*a*), an anodic bonding arrangement results from simultaneous bonding together of three sections, including a top plate 700, a bottom plate 702, and a middle plate 704 having a cavity 706 for gasses. The bonding may be performed at gas (He, Ar, etc.) pressure that is desired to fill the cavity 706 of the middle plate. The circuit and RF plasma metallization leads are not shown. The metal line may require oxide coatings for the anodic bonding to work. Referring to FIG. 7(*b*) the anodic bonding process may be carried out by placing the assembled plates on a hot plate 708 inside a gas with pressure P to ensure that the cavity 706 of the middle plate 704 will contain the gas at that pressure.

Figure 8:
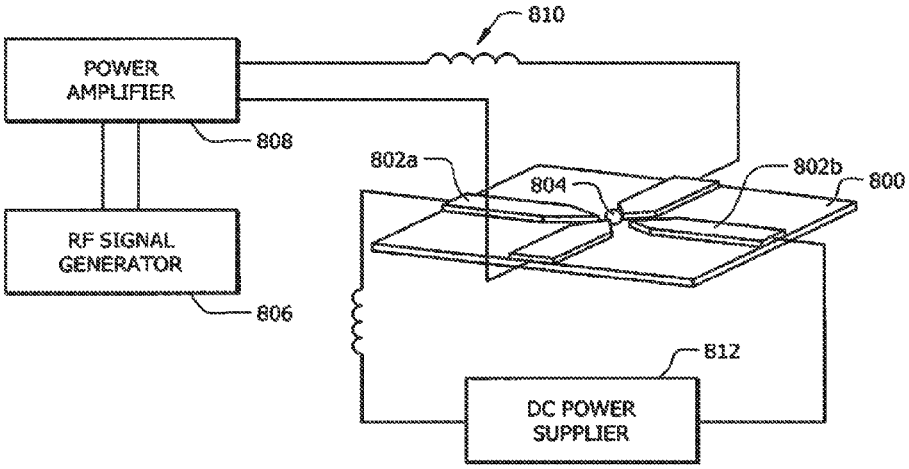
FIG. 8 depicts a diagrammatic view of another embodiment of a micro-plasma device in accordance with the present disclosure.
Figure 9:
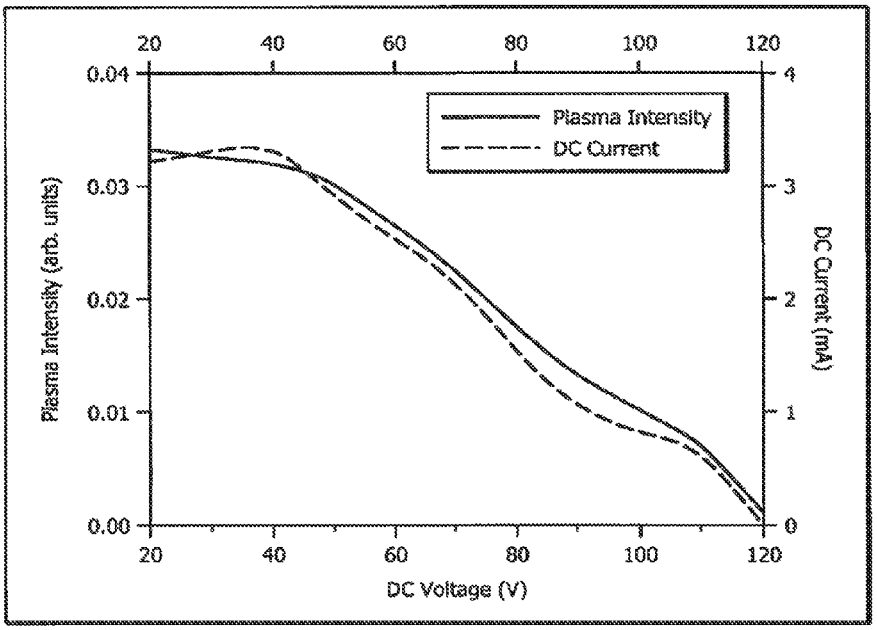
FIG. 9 depicts a graphical representation of the field effect of the micro-plasma device of FIG. 8.

Turning now to FIG. 8, another embodiment of an MPD may be comprised of a dielectric board 800 having a pair of switch electrodes 802*a* and 802*b* and RF plasma 804 generated by a pair of plasma generating electrodes. The plasma generators may be driven by an RF signal generator 806 via a power amplifier 808 and matching inductor 810. The switch electrodes may be driven by a DC power supplier 812. With this arrangement, the field effect of MPDs can be demonstrated, as shown in FIG. 9, where plasma intensity and DC current are graphically illustrated to vary with DC voltage.

Figure 10:
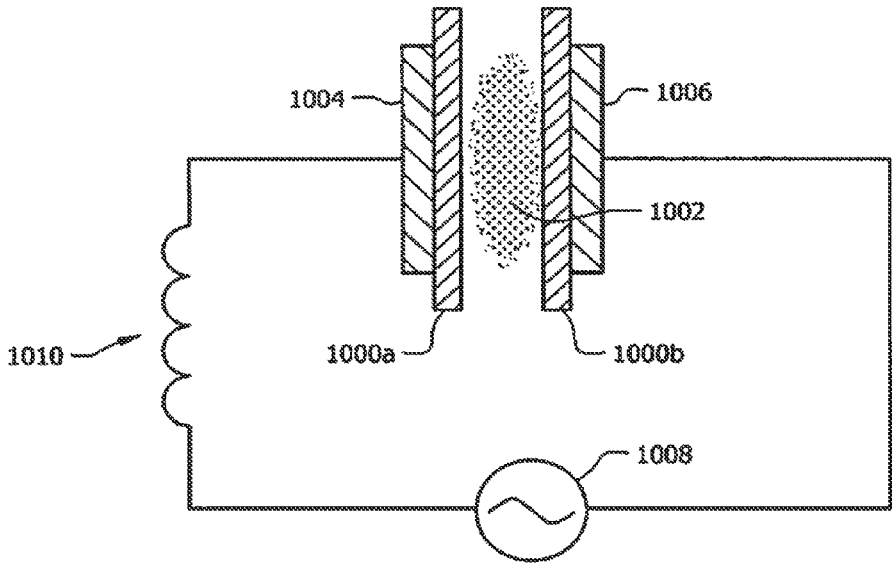
FIG. 10 depicts a sectional view of a further embodiment of a micro-plasma device in accordance with the present disclosure.
Figure 11:
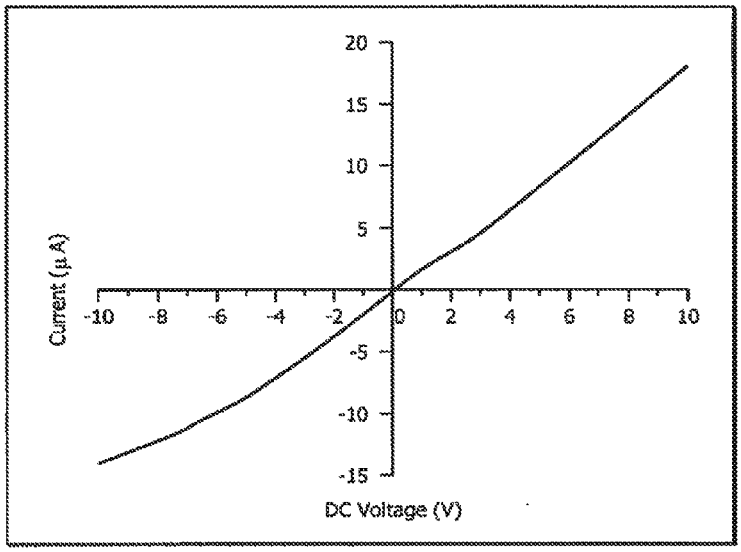
FIG. 11 depicts a graphical representation of the I-V characteristics of the micro-plasma device of FIG. 10.

Turning to FIG. 10, a further embodiment of an MPD may be designed with insulators for increased device lifetime. For example, a glass barrier 1000*a* and 1000*b* may be provided between He plasma 1002 and plasma generating electrodes 1004 and 1006. The electrodes 1004 and 1006 may be driven by an RF power supply 1008 via a matching inductor 1010. With this arrangement, the I-V characteristics of RF plasma between the glass barrier 1000 insulators may be measured by two electrodes 1004 and 1006 inside the He plasma 1002. The I-V characteristics thus measured are graphically illustrated in FIG. 11.

Figure 12:
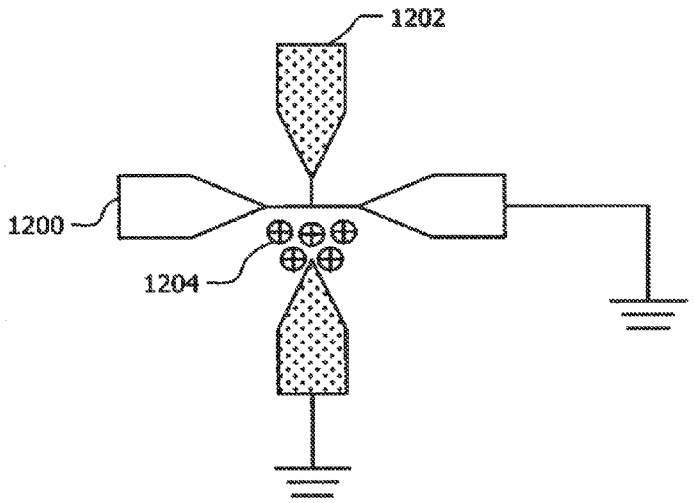
FIG. 12 depicts a plan view of the micro-plasma device of FIG. 8 demonstrating the switching off principle of plasma in accordance with the present disclosure.
Figure 13:
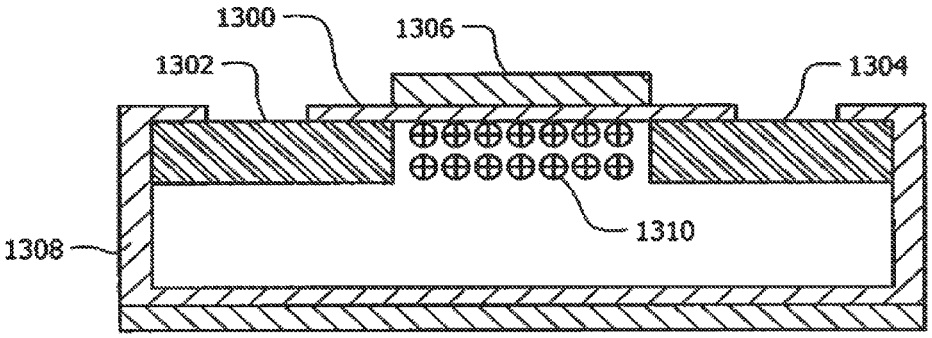
FIG. 13 depicts a sectional view of a micro-plasma transistor in accordance with the present disclosure.

Turning to FIG. 12, the switching off principle of plasma is demonstrated with the four probe setup outlined in FIG. 8. With RF power 1200 supplied to the plasma generating electrodes, and a voltage 1202 greater than zero supplied to the switching electrodes, the positively charged plasma ions 1204 are pushed away from the positively charged electrode. Thus, referring to FIG. 13, in a plasma transistor having a gate oxide 1300, source electrode 1302, drain electrode 1304, gate electrode 1306, and cavity with noble gases 1308, plasma ions 1310 between the source electrode 1302 and drain electrode 1304 may be affected by the voltage supplied to the gate electrode 1306.

The mode of operation of the transistor depends on the density of the ions 1310. For example, if the ion 1306 density is high, the insulated gate electrode 1306 can easily attract the ions 1310 or repel them. The ions 1310 are positively charged and can transfer electrons from the source electrode 1302 to drain electrode 1304. When their concentration increases in the D-S channel, they increase the Ids. When the plasma ion 1306 density is sufficiently high, the gate electrode 1306 field effect depletes the D-S channel to reduce the channel conductance. Accordingly, the conductive path between the source electrode 1302 and drain electrode 1304 provided by the plasma ions 1310 may be switched off by supply of voltage to the gate electrode 1306. On the other hand, when the starting ion 1310 density is low, D-S voltage ionizes the gas molecules. However, the ionization occurs at smaller voltage because of the presence of some ions that help the process. The gate electrode 1306, in this case, changes the "starter ion" concentration and modifies the ionization voltage. Thus, the same transistor operates as an enhancement mode device when the plasma density is low, but sufficient to enable Vds to ionize near-by gas molecules and increase the D-S channel conductance.

Figure 14:
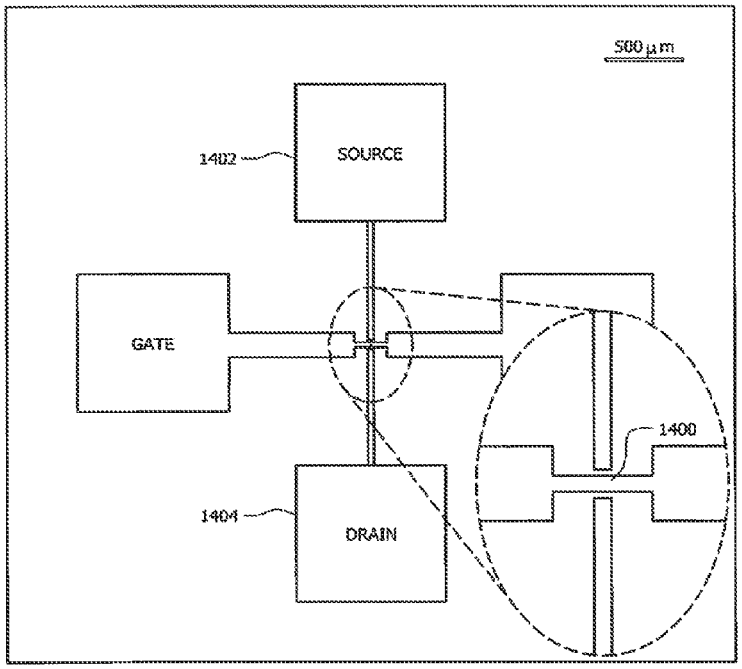
FIG. 14 depicts a sectional view of a fabricated MOPFET in accordance with the present disclosure.
Figure 15:
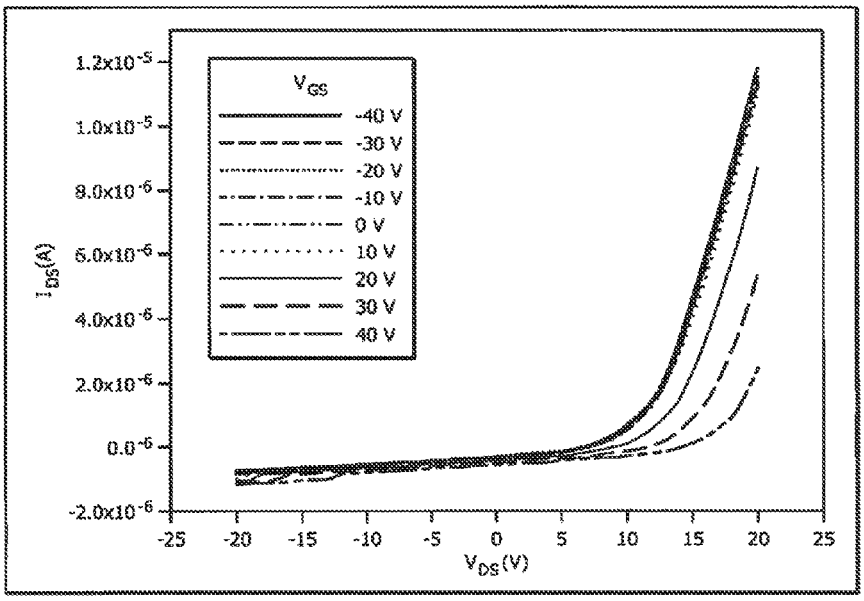
FIG. 15 depicts a graphical representation of the $I_{DS}$–$V_{DS}$ of a MOPFET for a variety of $V_{GS}$ in accordance with the present disclosure.
Figure 16:
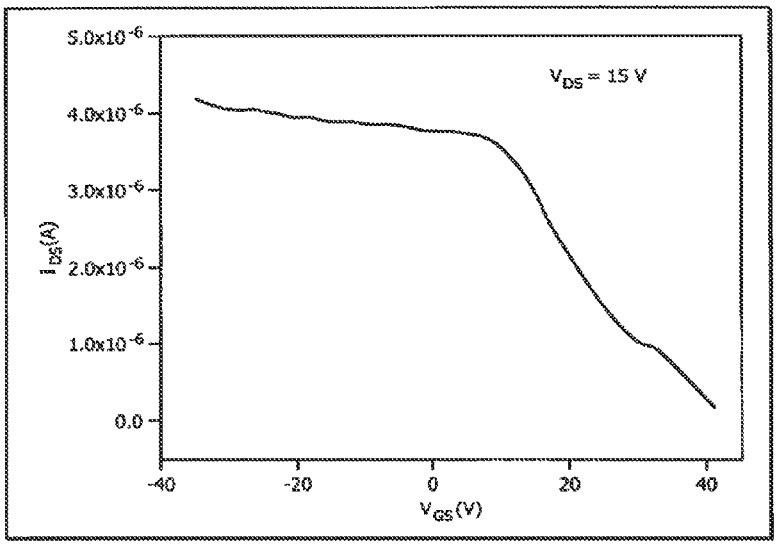
FIG. 16 depicts a graphical representation of the $I_{DS}$–$V_{GS}$ of a MOPFET for a $V_{DS}$ equal to 15V in accordance with the present disclosure.
Figure 17:
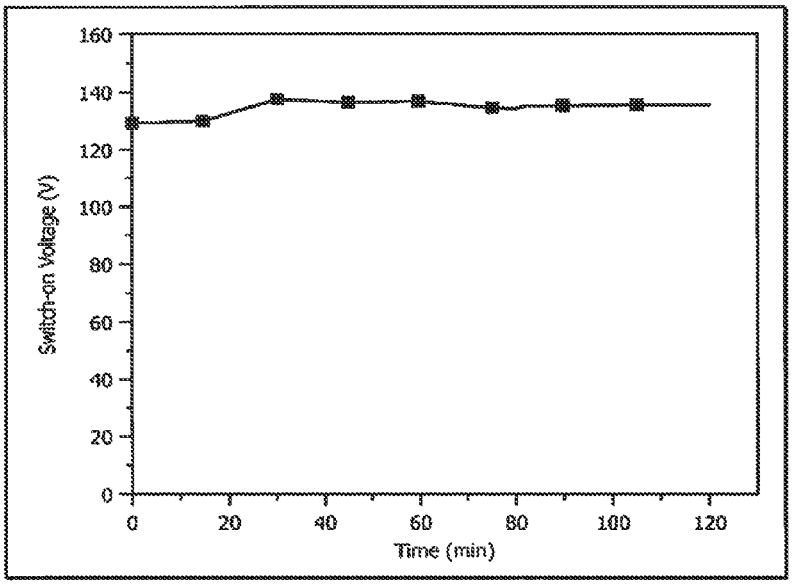
FIG. 17 depicts a graphical representation of the tested switching characteristics of a MOPFET inside a 90 keV nuclear reactor in accordance with the present disclosure.
Figure 18:
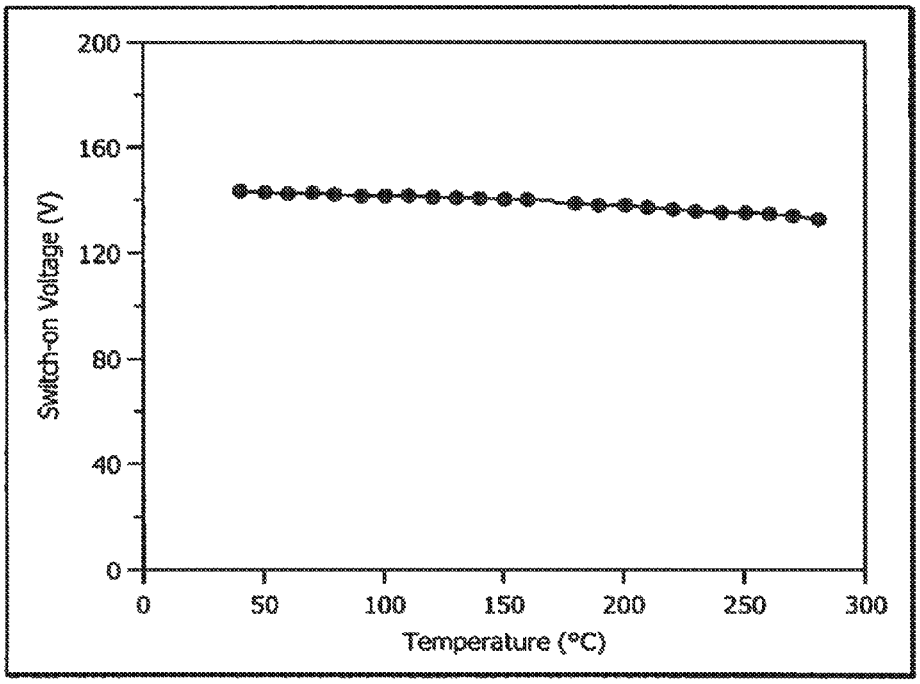
FIG. 18 depicts a graphical representation of the tested switching operation of a MOPFET at high temperatures in accordance with the present disclosure.

Turning to FIG. 14, a fabricated MOPFET demonstrates the dimension of a 15 μm gap 1400 between a source electrode 1402 and a drain electrode 1404. In this embodiment, the RF plasma is provided by an external plasma source. FIG. 15 demonstrates the $I_{DS}$–$V_{GS}$ of such a MOPFET for a variety of $V_{GS}$, while FIG. 16 demonstrates the $I_{DS}$–$V_{GS}$ for $V_{DS}$ equal to 15V. The tested switching characteristics of such an NE filled MOPFET inside a 90 keV nuclear reactor are graphically illustrated in FIG. 17, while FIG. 18 demonstrates the tested switching operation at high temperatures. Here, the switch-on voltage of the Ne filled plasma device decreases 1% at 100° C., and 4% at 200° C.

MPDs according to the invention can also be constructed such that the MPDs, and corresponding MPCs, do not require an external source of plasma. In the embodiments of the invention described above, the MPDs and MPCs include an external source of plasma (see FIGS. 1, 2A, and 2B). An external source of plasma is a source of plasma other than the drain electrode, source electrode, or gate electrode. For example, an MPD that does not include an external source of plasma generates all of the plasma required to produce a conductive path between the drain electrode and the source electrode based on a voltage applied to the drain electrode (and optionally regulated based on a voltage applied to the gate electrode). An MPD that includes an external source of plasma, such as the MPD illustrated in FIGS. 2A and 2B, includes plasma generating electrodes 208 that are separate from the drain electrode, source electrode, and gate electrode. Alternatively, an MPC, such as the MPC in FIG. 1, can include an external source of plasma that provides plasma to one or more MPDS. The external source of plasma allows for lower MPD drain-source voltages, $V_{DS}$, to be used for conduction than would be required for the same MPDs without the external source of plasma. For example, in the absence of the external plasma source, a drain-source voltage, $V_{DS}$, (i.e., breakdown voltage) of approximately 350V would be required to generate a plasma channel for an MPD with a drain-source gap or distance of approximately 10 μm.

The breakdown voltage that is required to generate a conductive plasma channel between the drain electrode and the source electrode is governed by Paschen's law for breakdown, which can be expressed mathematically as Townsend's breakdown criterion shown in EQN. 2.

$$\gamma_i\left[e^{Apd\ exp\left(\frac{-Bpd}{Vb}\right)}\right] = 1 \qquad \text{EQN. 2}$$

where $\gamma_i$ is the secondary emission coefficient for bombarding ions, A and B are empirical constants for a given gas, ρ is the pressure in Torr, d is the distance in cm, and $V_b$ is the breakdown voltage in Volts.

Figure 19:
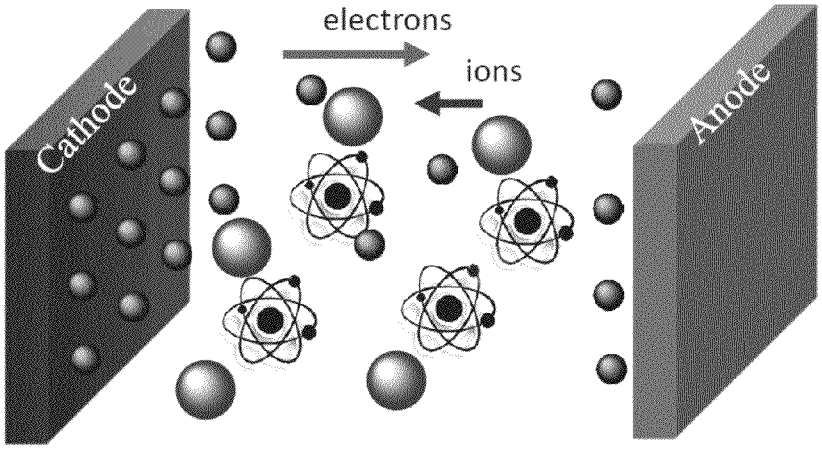
FIG. 19 illustrates electric breakdown in the Paschen regime.

According to the theory of electrical discharge and breakdown for a channel or gap of greater than 10 μm (i.e., between an anode and a cathode or drain and source), accelerated electrons collide with neutral molecules to produce ions and secondary electrons, as illustrated in FIG. 19. Plasma is generated when a rate of ionization of the molecules is greater than the rate of recombination of the ions. Solutions of EQN. 2 can be used to produce Paschen curves for any given gas. Typically, Paschen's curve shows an exponentially increasing trend in breakdown voltage for small values of ρd. In other words, the breakdown voltage of a gas is expected to increase exponentially for smaller electrode spacing under constant pressure.

Figure 20:
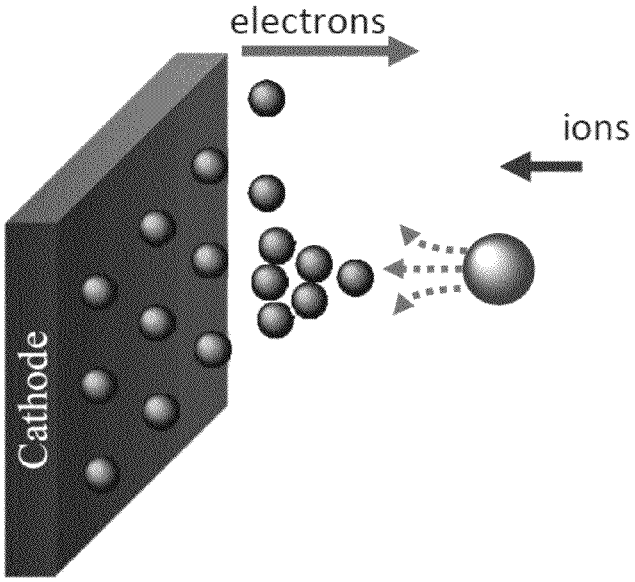
FIG. 20 illustrates electric breakdown in the sub-Paschen regime.

Paschen's law only holds, however, for channels or gaps that are larger than approximately 7 μm. Experimental work has demonstrated a steady decrease in breakdown voltage at smaller electrode spacing. The main reason for this behavior is ion-enhanced field-emission, which is not incorporated into Townsend's equation. Ion-enhanced field-emission is the phenomenon by which electrons are emitted from a cathode due to the localized electric field of an approaching positive ion, as illustrated in FIG. 20. A modified form of Townsend's equation is provided in EQN. 3, and is applicable to both Paschen and non-Paschen behavior:

$$(\gamma_i + \gamma')\left[e^{Apd\ exp\left(\frac{-Bpd}{Vb}\right)}\right] = 1 \quad \text{EQN. 3}$$

Figure 21:
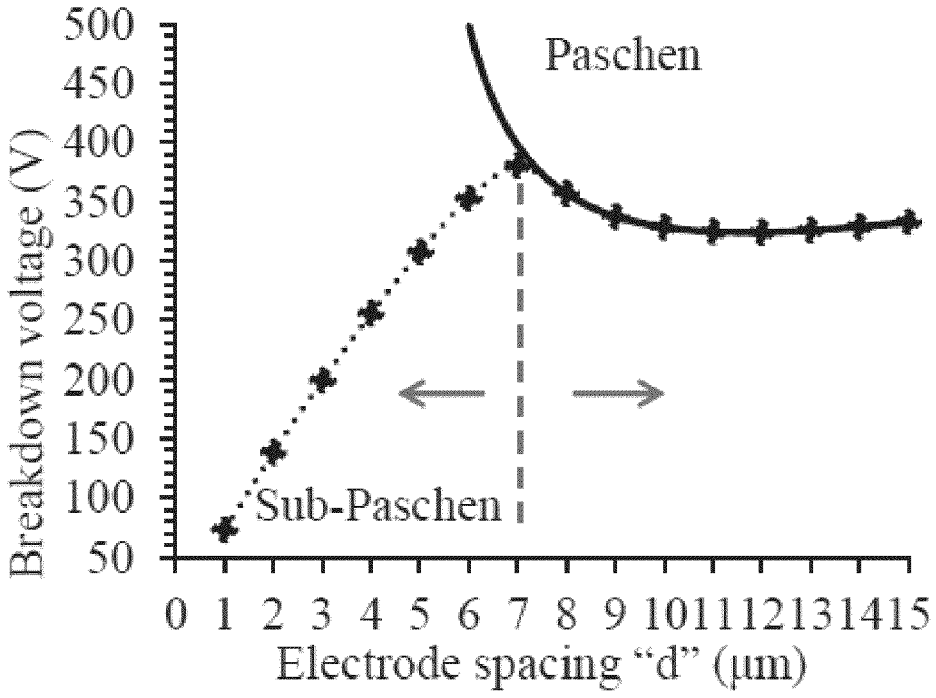
FIG. 21 is a graph of breakdown voltage vs. electrode spacing for the Paschen regime and the sub-Paschen regime.

A graph of the modified form of Townsend's equation is shown in FIG. 21 for both Paschen and sub-Paschen regions with respect to electrode spacing.

Figures 22A, 22B, 22C, 22D:
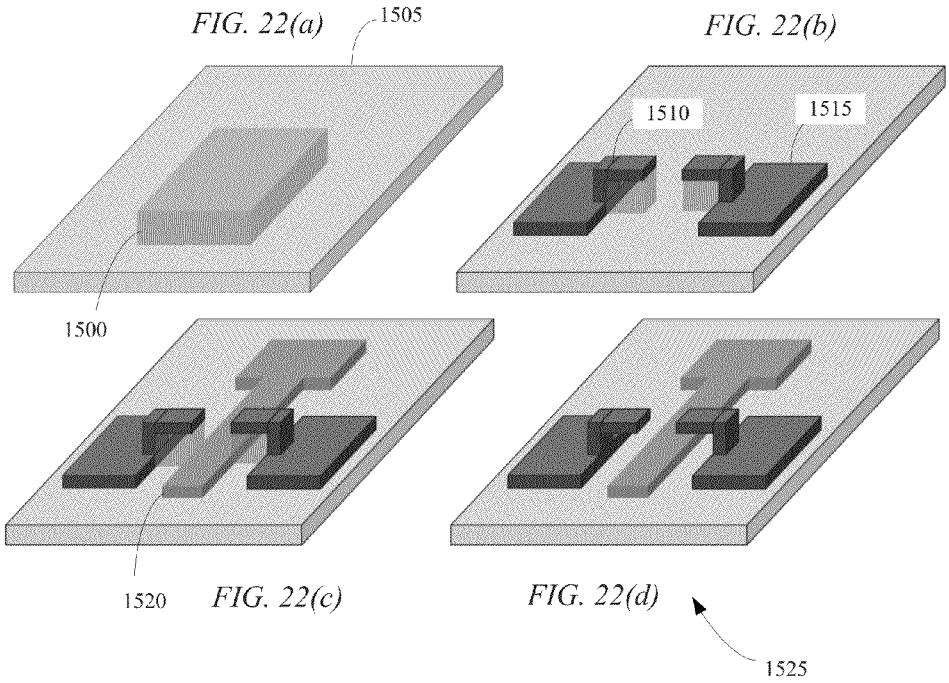
FIGS. 22(*a*)-22(*d*) illustrate a fabrication process for a micro-plasma device ("MPD") according to an embodiment of the invention.
Figure 23A:
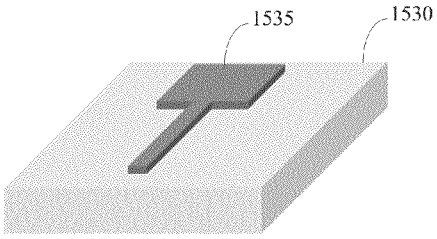
FIGS. 23(*a*)-23(*e*) illustrate a fabrication process for an MPD according to another embodiment of the invention.
Figure 23B:
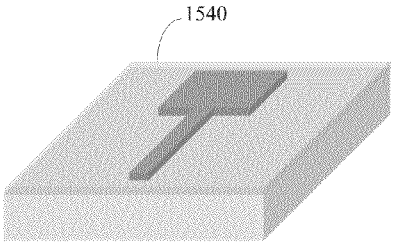
Figure 23C:
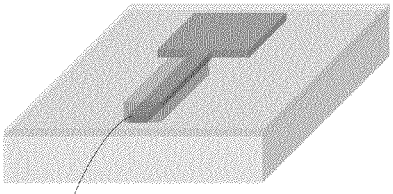
Figure 23D:
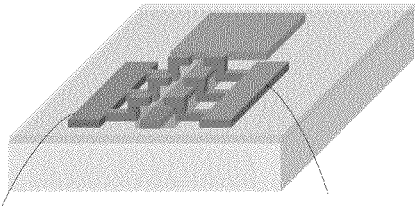
Figure 23E:
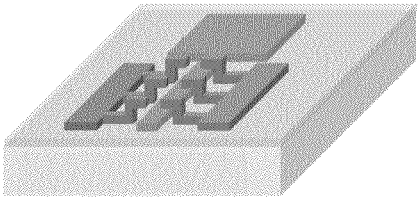

MPDs having electrode spacing in the sub-Paschen regions can be fabricated in a variety of ways. For example, in some embodiments, the fabrication process for an MPD (e.g., a MOPFET) is designed to produce a self-aligned gate electrode as illustrated in FIGS. 22(*a*)-22(*d*). A good gate alignment allows the source electrode and the drain electrode to be used interchangeably. The fabrication process begins with the deposition and patterning of a 0.5 μm thick layer 1500 of poly-Si on a glass substrate 1505 that defines the stand-off distance between the drain electrode, the source electrode, and the gate electrode, as shown in FIG. 22(*a*). In some embodiments, the width of the gate is made intentionally larger than the drain-source gap to accommodate for misalignment. A 0.5 μm thick layer of TiW is sputtered and patterned to define the drain electrode 1510 and source electrode 1515. The underlying poly-Si is patterned along with the drain-source to define a gate area, as shown in FIG. 22(*b*). A 0.2 μm thick layer of TiW is then sputtered and patterned along with the drain-source to define the gate 1520, as shown in FIG. 22(*c*). The sacrificial poly-Si is then etched away using $XeF_2$, as shown in FIG. 22(*d*). The MPD 1525 can then be enclosed through, for example, a bonding process (e.g., anodic, eutectic, etc.) to provide a sealed cavity or enclosure for plasma gases. In some embodiments, the plasma gas is sealed at atmospheric pressure. The drain electrode, the source electrode, and the gate electrode are interfaced with the plasma gas enclosure. The drain, source, and gate electrodes would be electrically accessible from the outside of the MPD packaging such that voltages can be applied to electrodes to turn the MPD ON. In some embodiments, the drain and source electrodes include ten sets of approximately 10 μm-wide fingers having an inter-finger separation of approximately 10 μm. In other embodiments, more or fewer than ten fingers are included in the source and drain electrodes.

Another fabrication process is illustrated in FIGS. 23(*a*)-23(*e*). In the fabrication process of FIGS. 23(*a*)-23(*e*), a 0.5 μm thick layer of TiW is deposited and patterned on a glass substrate 1530 to form a gate electrode 1535, as shown in FIG. 23(*a*). A 0.1 μm layer 1540 of $Al_2O_3$ is deposited over the gate electrode 1535 to form a gate oxide, as shown in FIG. 23(*b*). A 0.3 μm thick layer 1545 of poly-Si that defines the stand-off distance between the drain and source electrodes is then deposited and patterned, as shown in FIG. 23(*c*). In some embodiments, the width of the gate is made intentionally larger than the drain-source gap to accommodate for misalignment. A 0.5 μm layer of TiW is deposited and patterned to form the source electrode 1550 and drain electrode 1555, as shown in FIG. 23(*d*), and the sacrificial layer of poly-Si is etched away in $XeF_2$, as shown in FIG. 23(*e*). The MPD 1560 can then be enclosed through, for example, a bonding process (e.g., anodic, eutectic, etc.) to provide a sealed cavity or enclosure for plasma gases. In some embodiments, the plasma gas is sealed at atmospheric pressure. The drain electrode, the source electrode, and the gate electrode are interfaced with the plasma gas enclosure. The drain, source, and gate electrodes would be electrically accessible from the outside of the MPD packaging such that voltages can be applied to electrodes to turn the MPD on. In some embodiments, the drain and source electrodes include ten sets of approximately 10 μm-wide fingers having an inter-finger separation of approximately 10 μm. In other embodiments, more or fewer than ten fingers are included in the source and drain electrodes. The manufacturing processes of FIGS. 22(*a*)-22(*d*) and 23(*a*)-23(*e*) are illustrative examples of how an MPD could be manufactured but are not the only way that an MPD could be manufactured. In other embodiments, different materials and/or thicknesses of materials are used to manufacture an MPD.

Referring one again to FIG. 1, an MPC similar to that shown and described in FIG. 1 can be constructed using the MPDs 1525 and/or 1560 that do not include an external source of plasma. For example, the micro-plasma circuit could include the middle fused silica section 104 and the bottom fused silica plate 106. The bottom fused silica plate 106 may contain a circuit that includes standard elements, such as the resistors 108 and the capacitors 110, as well as one or more MPDs. Because the MPDs in such embodiments of the MPC do not require an external source of plasma, the top fused silica plate is not necessary to the operation of the MPC.

Also similar to the MPDs described above with respect to FIGS. 2A-3B, the MPDs 1525 and 1560 can be operated as depletion mode devices or as enhancement mode devices. The enhancement mode device operation is achieved when the plasma density is low, but sufficient to enable the drain-source voltage, $V_{DS}$, to ionize gas molecules and increase the drain-source channel conductance. The ionization voltage depends on plasma density, gate voltage, gate capacitance, and device geometry. The gate electrode modulates electron density in the channel using the field-effect. Changes in channel electron density change the drain-source current and the breakdown voltage of the plasma gas.

The MPDs 1525 and 1560 can also be used to develop logic gates as previously described with respect to FIGS. 6(*a*)-6(*c*). For example, a NOT gate 602 as described with respect to FIG. 6(*a*), a NAND gate 604 as described with respect to FIG. 6(*b*), and a NOR gate 610 as described with respect to FIG. 6(*c*) can each be produced to provide MPD-based logic circuits with the MPDs 1525 and 1560. As previously indicated with respect to the MPDs of FIGS. 2(*a*) and 2(*b*), the MPDS 1525 and 1560 can also be used to create other logic gates. It will be appreciated that NOR and NAND gates are universal, and that any other gates can be constructed using NOR or NAND gates. D-latches, flop-flops, and non-volatile memory devices may also be developed using the MPDs 1525 and 1560.

Figure 24:
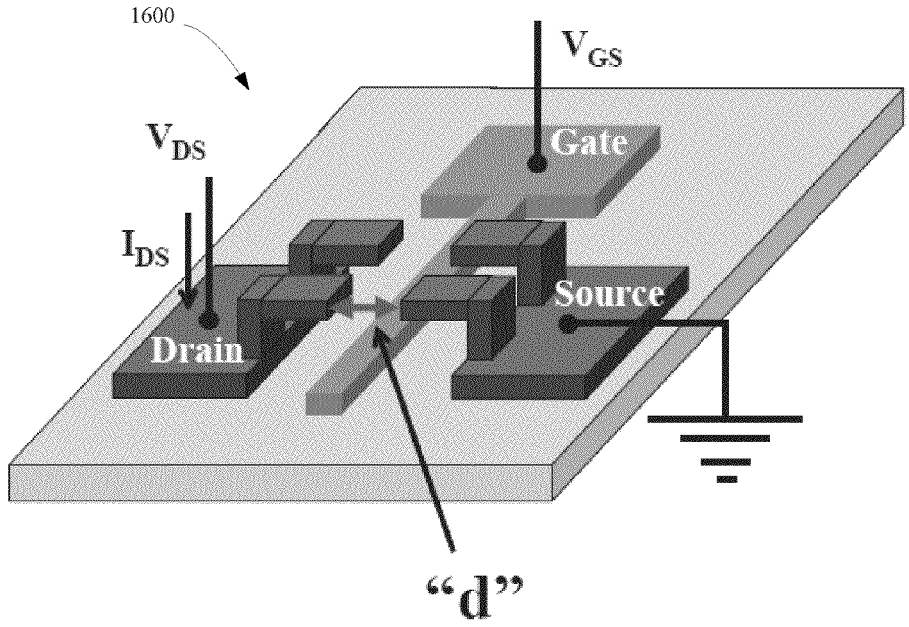
FIG. 24 illustrates an MPD according to an embodiment of the invention.

The MPDs can be operated and controlled by applying voltages to the drain electrode and gate electrode. For example, an MPD 1600 of FIG. 24 can be turned ON (i.e., caused to generate plasma between the drain electrode and the source electrode) by applying a direct current ("DC") excitation voltage to the drain electrode or by applying a radio-frequency ("RF") excitation voltage to the drain electrode. In some embodiments, RF frequencies range from approximately 3 KHz to approximately 300 GHz. The voltage that is required to be applied to the drain electrode for plasma to be generated is related to the distance or gap, d, between the drain electrode and the source electrode, as described above with respect to FIG. 21. For embodiments of the invention that are configured to operate in the sub-Paschen regime, the gap, d, between the drain electrode and the source electrode is, for example, less than approximately 5 μm. In some embodiments, the gap, d, is between approximately 1 μm and approximately 2 μm. The term "excitation voltage" is used to refer to the drain-source voltage, $V_{DS}$, which is used to generate the plasma and create a conducting channel. The dynamic response of the MPD 1600 is determined by the gate-source voltage, $V_{GS}$. For example, the drain-source current can be modulated by the gate voltage over a wide range of frequencies from DC to several GHz. In some embodiments, gate excitation voltages at frequencies of greater than a 10's of kHz are used to prevent sputtering damage to the gate electrode.

Figure 25:
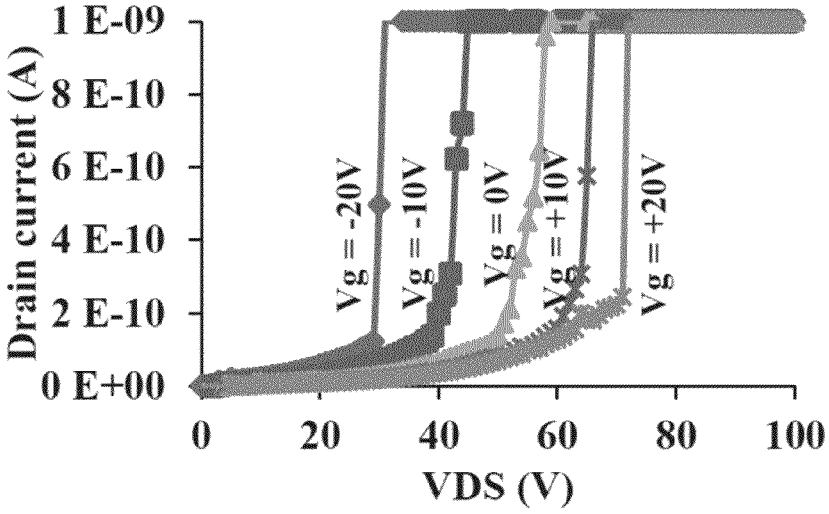
FIG. 25 is a graph of drain-source current vs. drain-source voltage, when an MPD according to an embodiment of the invention receives a direct current ("DC") excitation voltage.

When the MPD 1600 is excited using a DC voltage, conduction is due to both electrons and ions. However, the ions cause sputtering of the cathode which can damage the MPD if operated at a high current. To prevent damage in some embodiments, the drain-source current, $I_{DS}$, can be limited to approximately 10 nA or less. A DC drain-source voltage, $V_{DS}$, of between approximately 20V and approximately 80V is used to generate plasma. The drain-source voltage, $V_{DS}$, that is required to generate plasma can also be regulated by applying a positive or negative voltage to the gate electrode. The voltage applied to the gate electrode can be a DC voltage or an RF voltage. FIG. 25 illustrates the relationship between drain-source voltage and drain-source current for the MPD 1600 of the type illustrated in FIG. 24. As shown in FIG. 25, with no gate voltage applied (i.e., $V_G$=0V) a turn-on voltage of approximately 50V is achieved. By applying a positive voltage to the gate, turn-on voltage is increased. By applying a negative voltage to the gate, the turn-on voltage is decreased. As such, the gate field-effect can be used to control the conduction of the MPD 1600. The voltage applied to the gate interacts with the plasma and modulates the drain-source current, $I_{DS}$. In some embodiments, the MPD 1600 has a turn-on voltage of approximately 30V. The MPD under DC excitation experiences hysteresis similar to the hysteresis described previously with respect to the MPDs of FIGS. 2(*a*) and 2(*b*). MPDs operate as a constant voltage source for a given gate electrode bias.

Figure 26:
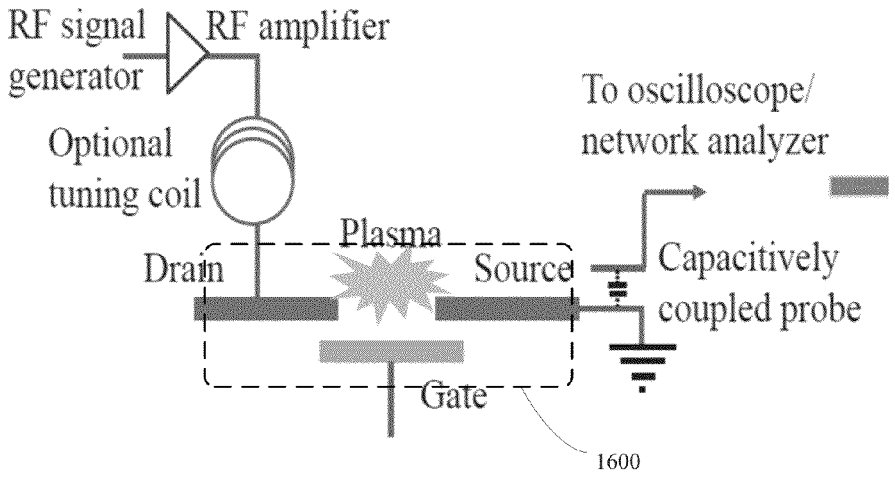
FIG. 26 illustrates an MPD in a micro-plasma circuit ("MPC") that receives a radio-frequency ("RF") excitation voltage with an unbiased gate electrode.
Figure 27:
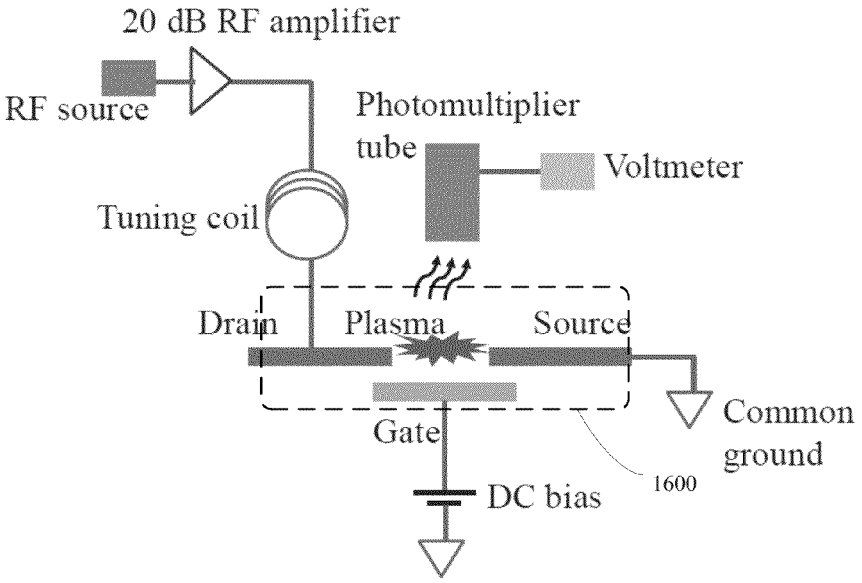
FIG. 27 illustrates an MPD in an MPC that receives an RF excitation voltage with a DC biased gate electrode.
Figure 28:
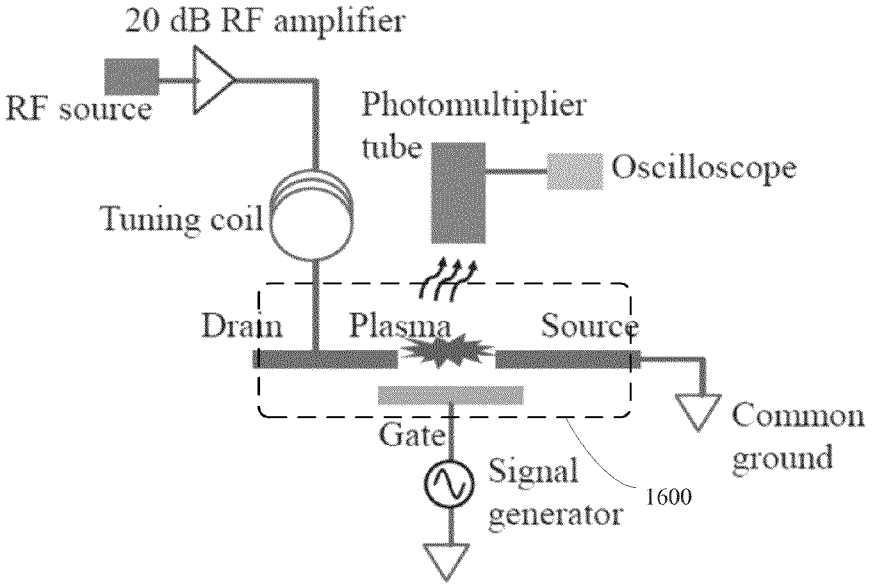
FIG. 28 illustrates an MPD in an MPC that receives an RF excitation voltage with an RF biased gate electrode.
Figure 29:
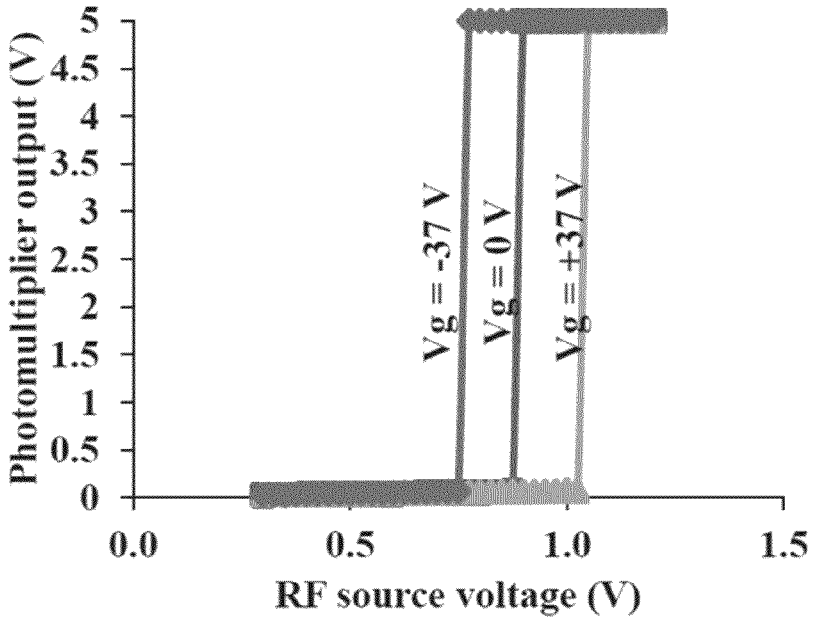
FIG. 29 is a graph of drain-source current vs. drain-source voltage, when an MPD according to an embodiment of the invention receives an RF excitation voltage.

When the MPD 1600 is excited using an RF voltage, conduction is almost entirely due to electrons because ions cannot instantaneously follow RF oscillations. Such operation results in less sputtering, which allows the MPD 1600 to be operated at higher currents (e.g., up to approximately 80 μA) and increases the life of the device. A drain-source voltage, $V_{DS}$, of between approximately 9V and approximately 15V is used to generate plasma. The frequency of the RF voltage signal can be varied. In some embodiments, the frequency of the RF voltage signal is between approximately 100 MHz and approximately 10 GHz. In some embodiments, RF excitation of the MPD 1600 is achieved as shown in FIG. 26. A voltage source circuit is connected to the drain electrode to provide an RF excitation voltage to the drain electrode. The circuit includes an RF signal generator, an RF amplifier, and a tuning coil. In FIG. 26, the gate electrode is unbiased. However, as shown in FIGS. 27 and 28, the gate electrode can be biased with a DC voltage (FIG. 27) or an RF voltage (FIG. 28). The drain-source current, $I_{DS}$, can be monitored using a photomultiplier (FIGS. 27 and 28) or using an oscilloscope/network analyzer (FIG. 26). FIG. 29 illustrates the relationship between drain-source voltage and drain-source current for the MPD 1600. As shown in FIG. 29, with no gate voltage applied (i.e., $V_G$=0V) a turn-on voltage of approximately 9V-10V is achieved (RF source voltage of approximately 1V is amplified by a factor of 5-10 by the RF amplifier and tuning coil). By applying a positive voltage to the gate, turn-on voltage is increased. By applying a negative voltage to the gate, the turn-on voltage is decreased. As such, the gate field-effect can be used to control the conduction of the MPD. Like the MPD under DC excitation, the MPD under RF excitation experiences hysteresis similar to the hysteresis described previously with respect to the MPDs of FIGS. 2(*a*) and 2(*b*).

Figure 30:
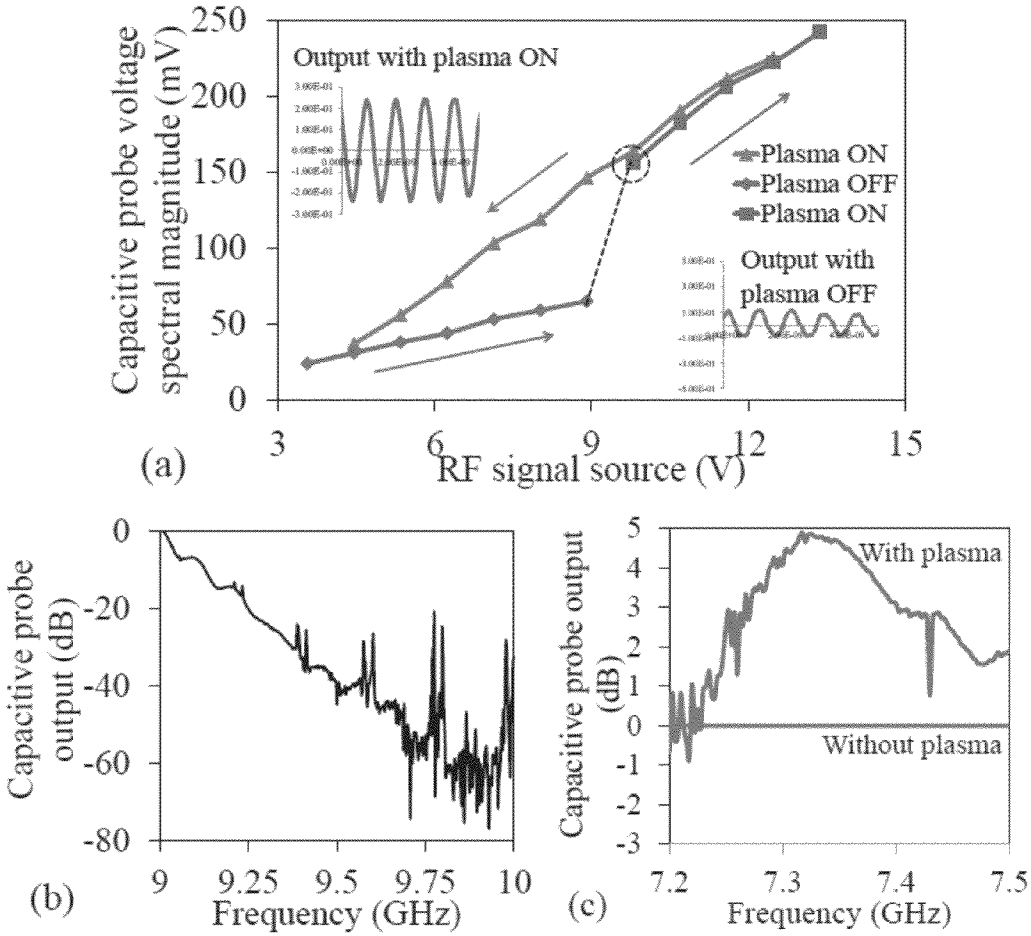
FIG. 30 illustrates the operation of an MPD according to an embodiment of the invention receives an RF excitation voltage at a frequency of between approximately 900 MHz and 10 GHz.

FIG. 30(*a*) illustrates details of the high-frequency RF excitation of the MPD 1600. At low excitation voltages, the output current is small with a gradually increasing slope until approximately 8.9V. The small current detected before plasma turn-on is due to the radiative leakage of microwaves. Capacitive probe voltage is related to output current. Plasma is generated at an excitation voltage of approximately 9.8V. Increasing the excitation voltage increases the output current. The slope of the current in FIG. 30(*a*) is steeper in the plasma ON region due to the smaller resistance of the plasma. FIG. 30(*b*) illustrates plasma current switching near 10 GHz. The plasma power reaches a maximum around 10 GHz and shows an approximately 30 dB difference in power between the ON state or condition and the OFF state or condition. The frequency selective behavior is due to the frequency response of the total impedance of the MPD 1600 as well as cables. For MPD characterization, the drain-source is excited by a lower frequency (e.g., approximately 600 MHz) compared to the higher frequency (e.g., approximately 7-10 GHz) gate excitation signal to avoid unnecessary interference in the detected output signal. The drain-source power used to establish plasma is fixed at, for example, 2 W and the gate signal is limited to 0.1 W for testing. FIG. 30(*c*) illustrates the characterization data for the MPD 1600. The gate excitation signal modulates the drain-source current at the gate excitation frequency by varying the electron density in the plasma, as shown in FIG. 30(*c*). The gate modulation illustrates a frequency selective behavior similar to that illustrated in FIG. 30(*b*) due to the frequency response of the lumped gate-source impedance. The modulation speeds obtained in FIG. 30(*c*) are greater than those for earlier MPDs by several orders of magnitude. The higher modulation speeds are due to low gate-source/drain capacitance, which is achieved through smaller overlap regions between the electrodes and lower parasitic capacitance obtained from the use of a glass substrate.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A micro-plasma device, comprising:

a plasma gas enclosure containing at least one plasma gas;

a drain electrode interfaced with the plasma gas enclosure; and a source electrode interfaced with the plasma gas enclosure, wherein the drain electrode and the source electrode are separated from each other by a distance, wherein the micro-plasma device is configured, when a voltage signal having a value greater than a breakdown voltage of the plasma gas between the drain electrode and the source electrode is applied to the drain electrode, to generate a conductive plasma path through the at least one plasma gas between the drain electrode and the source electrode.

2. The micro-plasma device of claim 1, wherein the at least one plasma gas includes a noble gas.

3. The micro-plasma device of claim 1, wherein the plasma enclosure is at least partially comprised of fused silica.

4. The micro-plasma device of claim 1, wherein the micro-plasma device does not include an external source of plasma.

5. The micro-plasma device of claim 4, wherein the voltage signal is a radio-frequency ("RF") voltage signal.

6. The micro-plasma device of claim 5, wherein the value of the voltage signal is less than approximately 10 Volts.

7. The micro-plasma device of claim 6, wherein the RF voltage signal has a frequency between approximately 100 MHz and approximately 10 GHz.

8. The micro-plasma device of claim 4, wherein the voltage signal is a direct-current ("DC") voltage signal.

9. The micro-plasma device of claim 8, wherein the value of the voltage signal is less than approximately 80 Volts.

10. The micro-plasma device of claim 1, wherein the distance between the drain electrode and the source electrode is less than or equal to approximately 5 micrometers ("μm").

11. The micro-plasma device of claim 10, wherein the distance between the drain electrode and the source electrode is between approximately 1 μm and 2 μm.

12. The micro-plasma device of claim 1, further comprising a gate electrode.

13. The micro-plasma device of claim 12, wherein a second voltage signal applied at the gate electrode is a radio-frequency ("RF") voltage signal.

14. The micro-plasma device of claim 12, wherein a second voltage signal applied at the gate electrode is a direct-current ("DC") voltage signal.

15. A micro-plasma circuitry apparatus, comprising:

a first layer having a cavity formed therein; and a second layer having a circuit formed therein including a micro-plasma circuit ("MPC") that includes one or more micro-plasma devices ("MPDs"), wherein the first layer is bonded to the second layer to form an enclosure that contains a plasma gas.

16. The micro-plasma circuitry apparatus of claim 15, wherein at least one MPD of the one or more MPDs includes a plurality of electrodes.

17. The micro-plasma circuitry apparatus of claim 16, wherein the MPD is a metal-oxide-plasma field-effect transistor ("MOPPET").

18. The micro-plasma circuitry apparatus of claim 16, wherein the MPD includes a drain electrode interfaced with the enclosure; and a source electrode interfaced with the enclosure, the drain electrode and the source electrode separated from each other by a distance.

19. The micro-plasma circuitry apparatus of claim 18, wherein the MPC further comprises a voltage source circuit connected to the drain electrode, the voltage source circuit configured to generate a voltage signal at the drain electrode having a value greater than a breakdown voltage of the plasma gas between the drain electrode and the source electrode to generate a conductive plasma path through the at least one plasma gas between the drain electrode and the source electrode.

20. The micro-plasma circuitry apparatus of claim 19, wherein the micro-plasma circuitry apparatus does not include an external source of plasma.

21. The micro-plasma circuitry apparatus of claim 20, wherein the voltage source circuit is configured to generate a radio-frequency ("RF") voltage signal.

22. The micro-plasma circuitry apparatus of claim 21, wherein the value of the voltage signal is less than approximately 10 Volts.

23. The micro-plasma circuitry apparatus of claim 22, wherein the RF voltage signal has a frequency between approximately 100 MHz and approximately 10 GHz.

24. The micro-plasma circuitry apparatus of claim 23, wherein the voltage source circuit includes an RF amplifier and a tuning coil.

25. The micro-plasma circuitry apparatus of claim 20, wherein the voltage source circuit is configured to generate a direct-current ("DC") voltage signal.

26. The micro-plasma circuitry apparatus of claim 25, wherein the value of the voltage signal is less than approximately 80 Volts.

27. The micro-plasma circuitry apparatus of claim 20, wherein the distance between the drain electrode and the source electrode is less than or equal to approximately 5 micrometers ("μm").

28. The micro-plasma circuitry apparatus of claim 27, wherein the distance between the drain electrode and the source electrode is between approximately 1 μm and approximately 2 μm.

29. The micro-plasma circuitry apparatus of claim 20, wherein the MPD further comprises a gate electrode, and the MPC further comprises a second voltage source circuit connected to the gate electrode.

30. The micro-plasma circuitry apparatus of claim 29, wherein second voltage source circuit is configured to generate a radio-frequency ("RF") voltage signal.

31. The micro-plasma circuitry apparatus of claim 29, wherein second voltage source circuit is configured to generate a direct-current ("DC") voltage signal.

32. The micro-plasma circuitry apparatus of claim 20, wherein the MPC is a NAND gate including at least two MPDs.

33. The micro-plasma circuitry apparatus of claim 20, wherein the MPC is a NOR gate including at least two MPDs.

34. The micro-plasma circuitry apparatus of claim 20, wherein the MPD is configured to operate as at least one of a switch or an amplifier for the MPC.

* * * * *